US006149167A

United States Patent [19]

Kao et al.

[11] Patent Number: 6,149,167

[45] Date of Patent: Nov. 21, 2000

[54] SHOCK ABSORBING STRUCTURE OF INLINE SKATES

[76] Inventors: Chuan-Fu Kao; Wen-Chang Hsu, both of P.O. Box 82-144, Taipei, Taiwan

[21] Appl. No.: 09/332,044

[22] Filed: Jun. 14, 1999

[51] Int. Cl.[7] ..... A63C 17/06

[52] U.S. Cl. ..... 280/11.225; 267/33; 280/11.233

[58] Field of Search ..... 267/33; 280/11.15, 280/11.221, 11.224, 11.225, 11.223, 11.27, 11.28, 11.233, 124.128, 124.162

[56] References Cited

U.S. PATENT DOCUMENTS

| | | | |
|---|---|---|---|
| 1,866,134 | 7/1932 | Smith | 280/11.223 |
| 5,405,156 | 4/1995 | Gonella | 280/11.225 X |
| 5,503,413 | 4/1996 | Belogour | 280/11.225 |
| 5,582,418 | 12/1996 | Closser | 280/11.225 |
| 5,704,621 | 1/1998 | Lazarevich | 280/11.225 X |
| 5,842,706 | 12/1998 | Chang | 280/11.225 X |
| 5,904,359 | 5/1999 | Caeran et al. | 280/11.223 X |
| 5,931,480 | 8/1999 | Schroeder | 280/11.225 X |

*Primary Examiner*—Michael Mar
*Attorney, Agent, or Firm*—A & J

[57] ABSTRACT

In an inline skate comprising a wheel frame provided with a rear wheel fixed axle at a rear portion thereof, a rear axle at a rear portion thereof, an intermediate fixed axle arranged between the rear wheel fixed axle and the rear axle, and a shock absorbing structure mounted between the rear wheel fixed axle, the rear axle and the intermediate fixed axle, the improvement wherein the shock absorbing structure comprises a front absorber and two rear absorbers, the front absorber comprising a first tubular member made of foamed plastic, two retainer rings each having an inner end slidably fitted into an end of the tubular member, and a first spring fitted inside said first tubular member and bearing against the two retainer rings, the two retainer rings being connected between the intermediate fixed axle and the rear wheel fixed axle, and each of the rear absorber comprising a second tubular member having an open end, a second spring fitted inside the second tubular member, a piston fitted inside the tubular member and formed with a plurality of axial though holes, a rod extending into the second tubular member to engage with the piston, a hydraulic fluid filled into the tubular member, a cover threadedly engaged with an open end of the tubular member, and a retainer threadedly engaged with an outer end of the rod.

1 Claim, 4 Drawing Sheets

SHOCK ABSORBING STRUCTURE OF INLINE SKATES

BACKGROUND OF THE INVENTION

1. Field of the Invention

This invention is related to an improvement in shock absorbing structure of inline skates.

2. Description of the Prior Art

It has been found that the conventional inline skate is provided with a shock absorber on the wheel frame to make travelling more comfortable. The shock absorber is generally constituted by two shafts sleeved on each other for fixedly mounting on an axle of the wheel frame and a spring enclosing the shafts. Nevertheless, such a shock absorber cannot effectively lessen the effect or absorb the force of shocks and jarring thereby making it unfit for practical use.

Therefore, it is an object of the present invention to provide an improvement in the shock absorbing structure of an inline skate which can obviate and mitigate the above-mentioned drawbacks.

SUMMARY OF THE INVENTION

This invention is related to an improvement in the shock absorbing structure of an inline skate.

It is the primary object of the present invention to provide a shock absorbing structure which can effectively absorb the force of shocks.

According to a preferred embodiment of the present invention, an inline skate comprises a wheel frame provided with a rear wheel fixed axle at a rear portion thereof, a rear axle at a rear portion thereof, an intermediate fixed axle arranged between the rear wheel fixed axle and the rear axle, and a shock absorbing structure mounted between the rear wheel fixed axle, the rear axle and the intermediate fixed axle, the improvement wherein the shock absorbing structure comprises a front absorber and two rear absorbers, the front absorber comprising a first tubular member made of foamed plastic, two retainer rings each having an inner end slidably fitted into an end of the tubular member, and a first spring fitted inside said first tubular member and bearing against the two retainer rings, the two retainer rings being connected between the intermediate fixed axle and the rear wheel fixed axle, and each of the rear absorber comprising a second tubular member having an open end, a second spring fitted inside the second tubular member, a piston fitted inside the tubular member and formed with a plurality of axial though holes, a rod extending into the second tubular member to engage with the piston, a hydraulic fluid filled into the tubular member, a cover threadedly engaged with an open end of the tubular member, and a retainer threadedly engaged with an outer end of the rod.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
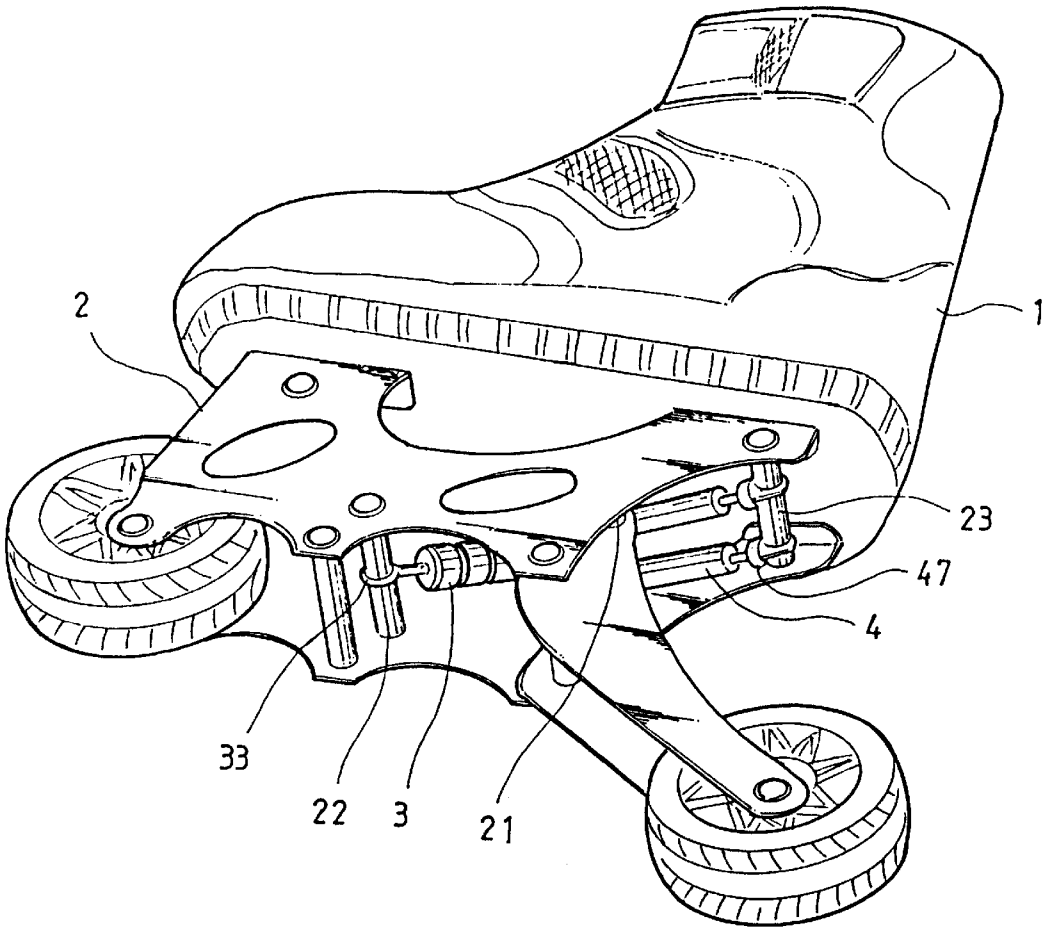
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, a front absorber 3 and two rear absorbers 4 are mounted between the rear wheel fixed axle 21, the intermediate fixed axle 22 and the rear axle 23 of the wheel frame 2 of the inline skate 1, so that when the inline skate travels, the front absorber 3 will be compressed while the rear absorbers 4 will be extended thereby lessening the force of shocks. As shown in FIG. 1, the wheel frame includes a first frame member attached to a boot and a second frame member. A forward end of the second frame member is pivotally connected to the first frame member. A front wheel is rotatably attached to the first frame member and a rear wheel is rotatably attached to a rearward end of the second frame member. The intermediate fixed axle 22 and the rear axle 23 are formed by pivot shafts connected to the first frame member. The rear wheel fixed axle 21 is formed by a pivot shaft connected to a forward portion of the second frame member.

Figure 2:
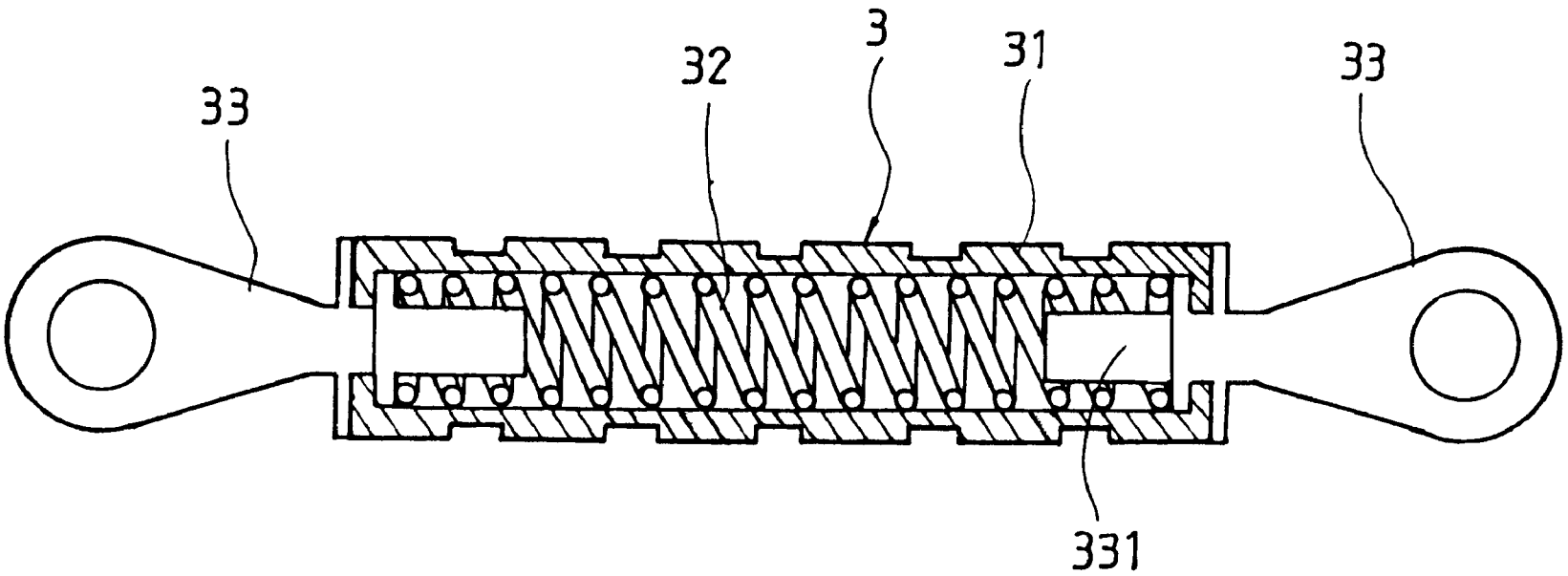
FIG. 2 illustrates the structure of the front absorber.

Referring to FIG. 2, the front absorber 3 comprises a tubular member 31 made of foamed plastic, two retainer rings 33 each having an inner end 331 slidably fitted into an end of the tubular member 31, and a spring 32 fitted inside the tubular member 31 and bearing against the two retainer rings 33. The front absorber 3 is connected between the intermediate fixed axle 22 and the rear wheel fixed axle 21 for absorbing the force of shocks.

Figure 3:
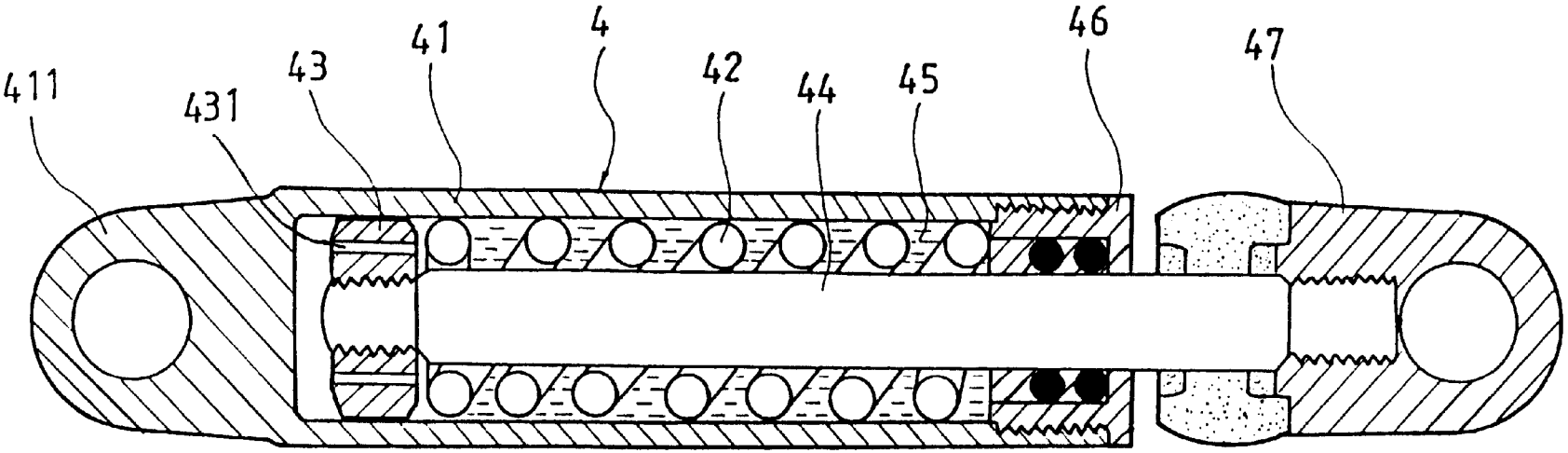
FIG. 3 illustrates the structure of the rear absorber.

Referring to FIG. 3, the rear absorber 4 comprises a tubular member 41 having an open end, a spring 42 fitted inside the tubular member 41, a piston 43 fitted inside the tubular member 41 and formed with a plurality of axial though holes 431, a rod 44 extending into the tubular member 41 to engage with the piston 43, hydraulic fluid 45 filled into the tubular member 41, a cover threadedly engaged with the open end of the tubular member 41, and a retainer 47 threadedly engaged with an outer end of the rod 44. The end 411 of the tubular member 41 and the retainer 47 are mounted between the rear wheel fixed axle 21 and the rear axle 23, so that by means of the rod 44, the spring 42 and the hydraulic fluid 45, the rear absorber 4 can effectively absorb the force of shocks.

Figure 4:
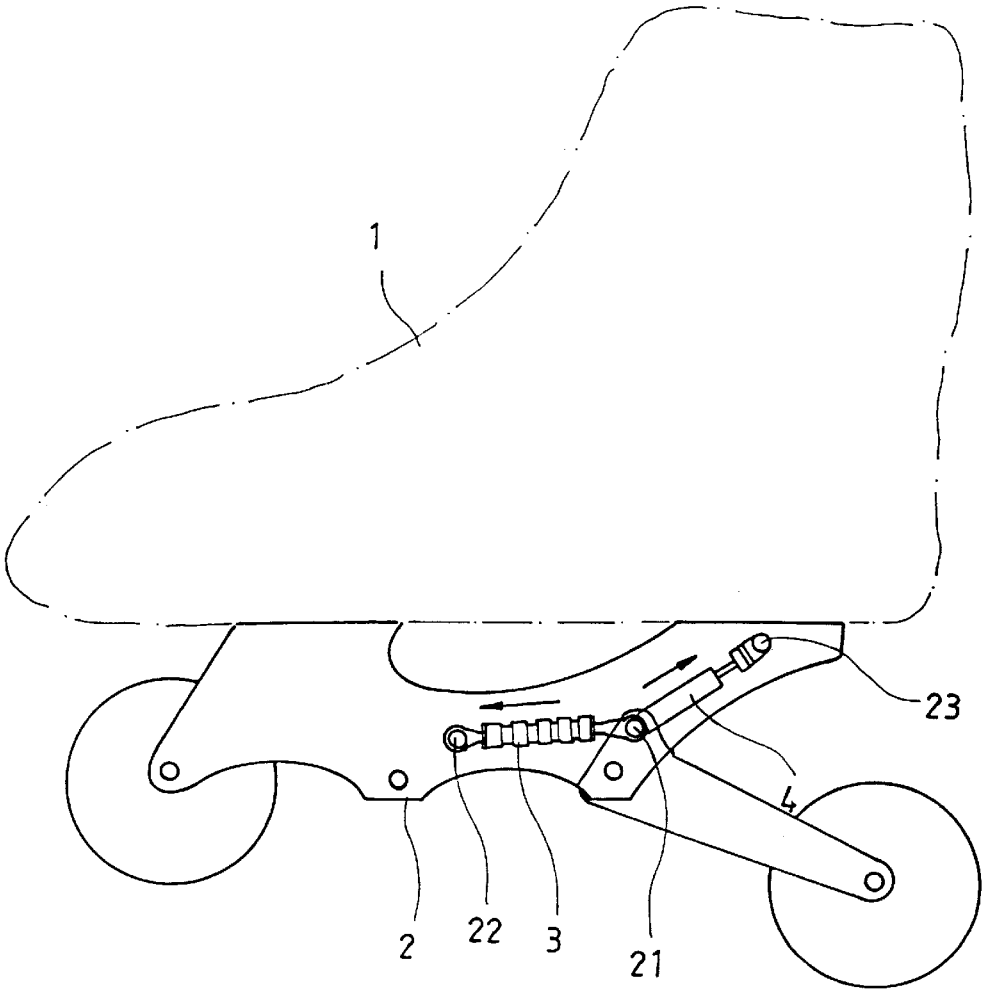
FIG. 4 is a working view of the present invention.

Referring to FIG. 4, when the inline skate 1 travels on uneven ground, the front absorber 3 between the rear wheel fixed axle 21 and the intermediate fixed axle 22 will be compressed, while the rear absorbers 4 between the rear wheel fixed axle 21 and the rear axle 23 will be pulled outwardly thereby effectively absorbing the force of shocks.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. An in-line skate comprising a first frame member and a second frame member, a front wheel rotatably connected to the first frame member and a rear wheel rotatably connected to a rearward end of the second frame member, a first pivot shaft mounted to an intermediate portion of the first frame member, a second pivot shaft mounted to a rear end portion of the first frame member, and a third pivot shaft mounted to a front end portion of the second frame member, the front end portion of the second frame member being pivotally connected to the first frame member at a location between the first and second pivot shafts, a front shock absorber and two rear shock absorbers, said front shock absorber including a first tubular member made of foamed plastic, two retainer rings, each retainer ring having an inner end slidably fitted into a respective end of the first tubular member, and a first spring fitted inside said first tubular member and bearing against the inner ends of said two retainer rings, said two retainer rings being pivotally connected to said first and third pivot shafts, and each of said rear shock absorbers including a second tubular member having an open end, a cover threadedly attached to the open end, a second spring fitted within said second tubular member, a piston fitted within said second tubular member and formed with a plurality of axial through holes, a rod having an inner end extending through an opening of said cover and connected to said piston, hydraulic fluid contained within said second tubular member, a first retainer threadedly engaged with an outer end of said rod and a second retainer formed at a closed end of said second tubular member, the first and second retainers of each rear shock absorber being pivotally connected to the second and third pivot shafts respectively.

* * * * *